US010233943B2

(12) United States Patent
Moriyama

(10) Patent No.: US 10,233,943 B2
(45) Date of Patent: Mar. 19, 2019

(54) VACUUM PUMP CONTROL DEVICE

(71) Applicant: Shimadzu Corporation, Kyoto (JP)

(72) Inventor: Nobuhiko Moriyama, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 15/479,433

(22) Filed: Apr. 5, 2017

(65) Prior Publication Data

US 2018/0291926 A1 Oct. 11, 2018

(51) Int. Cl.
*F04D 29/58* (2006.01)
*F04D 25/06* (2006.01)
*F04D 29/058* (2006.01)

(52) U.S. Cl.
CPC ..... *F04D 29/5813* (2013.01); *F04D 25/06* (2013.01); *F04D 29/058* (2013.01)

(58) Field of Classification Search
CPC .... F04D 25/06; F04D 29/5813; F04D 29/058; H05K 7/20218; H05K 7/20272
USPC ..... 417/228, 423.4
See application file for complete search history.

(56) References Cited

U.S. PATENT DOCUMENTS 6,000,912 A * 12/1999 Takada ..... G05D 23/1921 417/32
9,964,112 B2 * 5/2018 Yamato ..... F04D 19/042
2002/0131877 A1 * 9/2002 Omori ..... F04D 19/042 417/353
2008/0104987 A1 * 5/2008 Carlsen ..... F25D 21/04 62/272
2010/0247350 A1 * 9/2010 Nagano ..... F04B 35/045 417/410.1
2010/0303644 A1 * 12/2010 Moriyama ..... F04D 19/042 417/228
2015/0184665 A1 * 7/2015 Yamato ..... F04D 19/042 415/47

FOREIGN PATENT DOCUMENTS

JP 2008-151739 7/2008
JP 2014-043827 A 3/2014
WO WO 2014/139141 9/2014

* cited by examiner

*Primary Examiner* — Charles G Freay
(74) *Attorney, Agent, or Firm* — Renner Otto Boisselle & Sklar, LLP

(57) ABSTRACT

A vacuum pump control device comprises: a pump controller configured to control a vacuum pump; a cooling device configured to cool the pump controller; a housing configured to house the pump controller; a temperature sensor configured to detect, in the housing, a temperature at one of a first position or a second position having a higher temperature than that at the first position; a humidity sensor configured to detect a humidity at the second position in the housing; a temperature estimator configured to estimate a temperature at the other one of the first position or the second position based on the temperature detected by the temperature sensor; and a cooling controller configured to control execution and stop of cooling operation by the cooling device based on the temperature estimated by the temperature estimator, the temperature detected by the temperature sensor, and the humidity detected by the humidity sensor.

8 Claims, 9 Drawing Sheets

VACUUM PUMP CONTROL DEVICE

BACKGROUND OF THE INVENTION

1. Technical Field

The present invention relates to a vacuum pump control device.

2. Background Art

A vacuum pump used for vacuum exhausting in an external device such as a semiconductor manufacturing device includes a pump main body and a control device configured to control the pump main body. The control device is cooled with refrigerant such as coolant water. Normally, the control device has a semi-closed structure, and a dew-point temperature in the control device is the same as a temperature outside the control device, i.e., an external temperature. Thus, when the control device is cooled with refrigerant, the inside of the control device locally has a temperature lower than the dew-point temperature, and dew condensation might be caused.

Patent Literature 1 (JP-A-2014-43827) has proposed a vacuum pump configured as follows: a first temperature detection unit is provided at a low-temperature portion in the control device, a second temperature detection unit and a humidity detection unit are provided at a high-temperature portion in the control device, and operation of a cooling device is controlled based on the relative humidity of the low-temperature portion calculated using information detected by each detection unit.

However, in a technique of Patent Literature 1, there is a problem that a dew condensation state cannot be properly determined when erroneous detection is made in any one of the three detection units (sensors).

SUMMARY OF THE INVENTION

A vacuum pump control device comprises: a pump controller configured to control a vacuum pump; a cooling device configured to cool the pump controller; a housing configured to house the pump controller; a temperature sensor configured to detect, in the housing, a temperature at one of a first position or a second position having a higher temperature than that at the first position; a humidity sensor configured to detect a humidity at the second position in the housing; a temperature estimator configured to estimate a temperature at the other one of the first position or the second position based on the temperature detected by the temperature sensor; and a cooling controller configured to control execution and stop of cooling operation by the cooling device based on the temperature estimated by the temperature estimator, the temperature detected by the temperature sensor, and the humidity detected by the humidity sensor.

Preferably the temperature estimator estimates the temperature at the second position in such a manner that multiplication or addition is, using a constant, performed for the temperature detected at the first position by the temperature sensor, or estimates the temperature at the first position in such a manner that division or subtraction is, using a constant, performed for the temperature detected at the second position by the temperature sensor.

Preferably the cooling controller includes a condition determiner configured to determine that a dew condensation state is brought when the humidity is higher than a predetermined humidity and determine that the dew condensation state is not brought when the humidity is lower than the predetermined humidity, and an operation controller configured to stop the cooling operation when a state determined as the dew condensation state is continued for a predetermined time. The predetermined time is set as a time indicating stable temperature distribution in the housing. When the cooling operation is stopped, if the temperature in the housing reaches higher than the first temperature, the operation controller executes the cooling operation.

Preferably the operation controller executes, regardless of whether or not the dew condensation state is brought, the cooling operation until the temperature in the housing reaches lower than a second temperature lower than the first temperature when the cooling operation is executed, and stops the cooling operation when the temperature in the housing reaches lower than the second temperature.

Preferably when the cooling operation is executed, the temperature estimator estimates the temperature such that a difference between the temperature detected by the temperature sensor and the estimated temperature is greater than that when the cooling operation is stopped.

Preferably when a load of a motor configured to drive the vacuum pump is higher than a predetermined load, the temperature estimator estimates the temperature such that a difference between the temperature detected by the temperature sensor and the estimated temperature is greater than that when the load of the motor is lower than the predetermined load.

Preferably the cooling device includes a flow path formation body forming a cooling flow path through which refrigerant for cooling the pump controller circulates. A metal substrate is connected to the flow path formation body so that heat can be transferred. The temperature sensor is surface-mounted on the substrate at the first position.

According to the present invention, the number of detected information types can be reduced. Thus, the probability of occurrence of erroneous detection can be reduced, and reliability in detection of the dew condensation state can be improved.

DETAILED DESCRIPTION OF THE EXEMPLARY EMBODIMENTS

Hereinafter, an embodiment of a vacuum pump will be described with reference to the drawings.

First Embodiment

Figure 1:
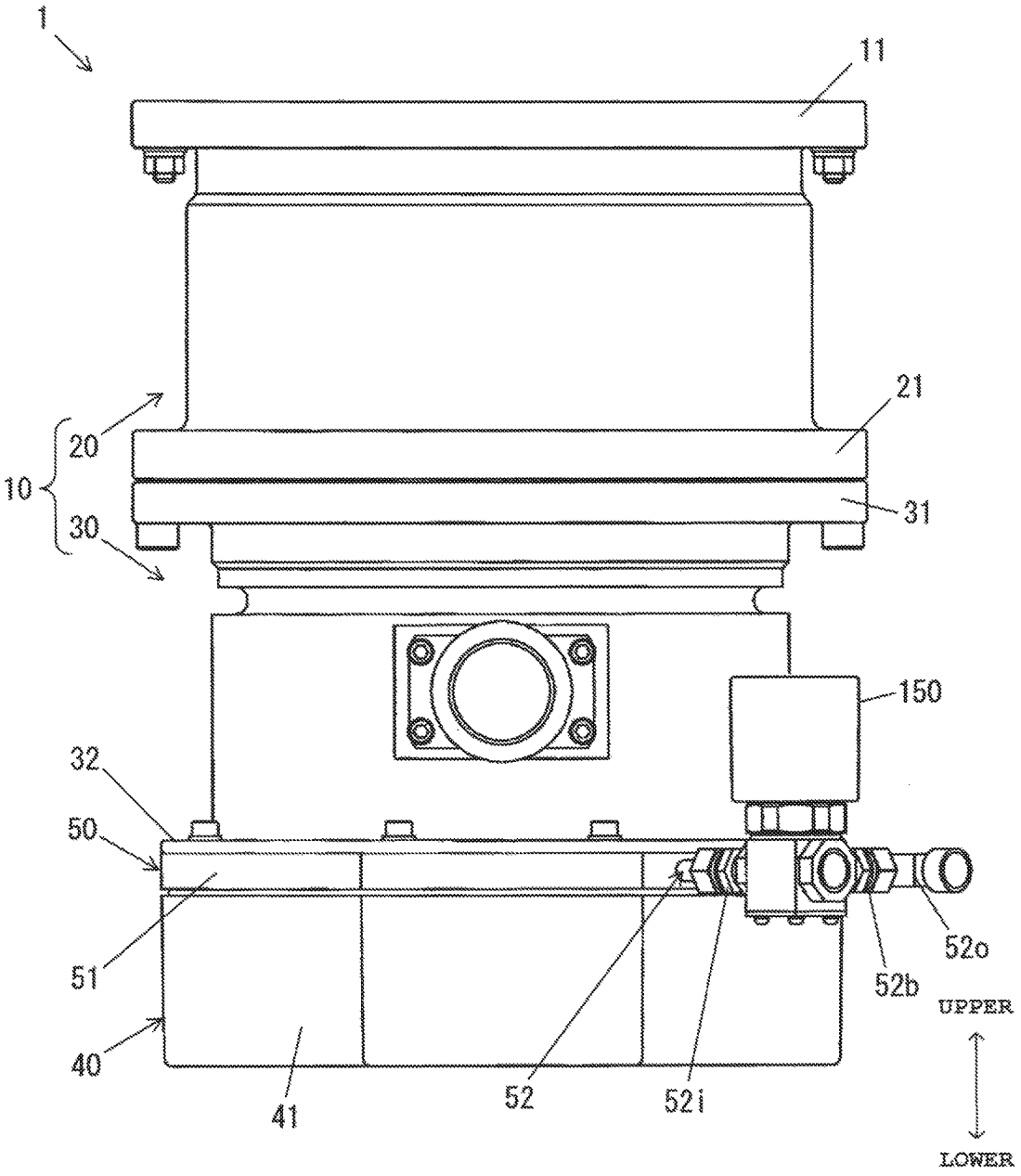
FIG. 1 is a view of a turbo-molecular pump of a first embodiment.

FIG. 1 is a view of a turbo-molecular pump 1 as an example of a vacuum pump. Note that for the sake of description, an upper-to-lower direction is defined as illustrated in FIG. 1 in the present specification.

The turbo-molecular pump 1 includes a pump main body 10, a control device 40 configured to control driving of the pump main body 10, and a cooling device 50 disposed between the pump main body 10 and the control device 40. A suction port flange 11 provided at the pump main body 10 is fixed to a vacuum chamber of an external device (not shown) such as a semiconductor manufacturing device, a liquid crystal panel manufacturing device, or an analysis device, and in this manner, the turbo-molecular pump 1 is attached to the external device (not shown). In the pump main body 10, a rotary body (not shown) provided with a rotor blade and a motor (not shown in FIG. 1) configured to rotatably drive the rotary body are housed. Note that the rotary body is non-contact supported by an electromagnet forming a magnetic bearing (not shown in FIG. 1).

The pump main body 10 includes a pump case having an upper casing 20 and a lower casing 30 attached to a lower portion of the upper casing 20. The upper casing 20 and the lower casing 30 are integrally coupled together in such a manner that flanges 21, 31 of these casings are fastened together with a bolt.

A flange 32 provided at a lower end of the lower casing 30 is, with a bolt, fixed to a cooling block 51 of the cooling device 50, and in this manner, the lower casing 30 and the cooling block 51 are integrally coupled together. A housing 41 of the control device 40 is integrally coupled with the cooling block 51 with a bolt. The housing 41 is formed in a substantially rectangular box shape with an opening on the upper side, and the upper opening is closed by the cooling block 51. The housing 41 is configured to communicate with the outside, and has a semi-closed structure for preventing droplets and dust from entering the housing 41.

The cooling device 50 is a device configured to cool the pump main body 10 and the control device 40, and includes the cooling block 51, a cooling pipe 52, and a three-way valve 150. The cooling block 51 is in a flat plate shape. The cooling block 51 has an upper surface connected so that heat can be transferred to the pump main body 10, and a lower surface connected so that heat can be transferred to the control device 40. In the cooling block 51, the cooling pipe 52 is disposed. The cooling pipe 52 forms a cooling flow path through which water circulates as refrigerant, and is provided with a refrigerant inlet 52*i* and a refrigerant outlet 52*o* protruding laterally from the cooling block 51.

Figure 2:
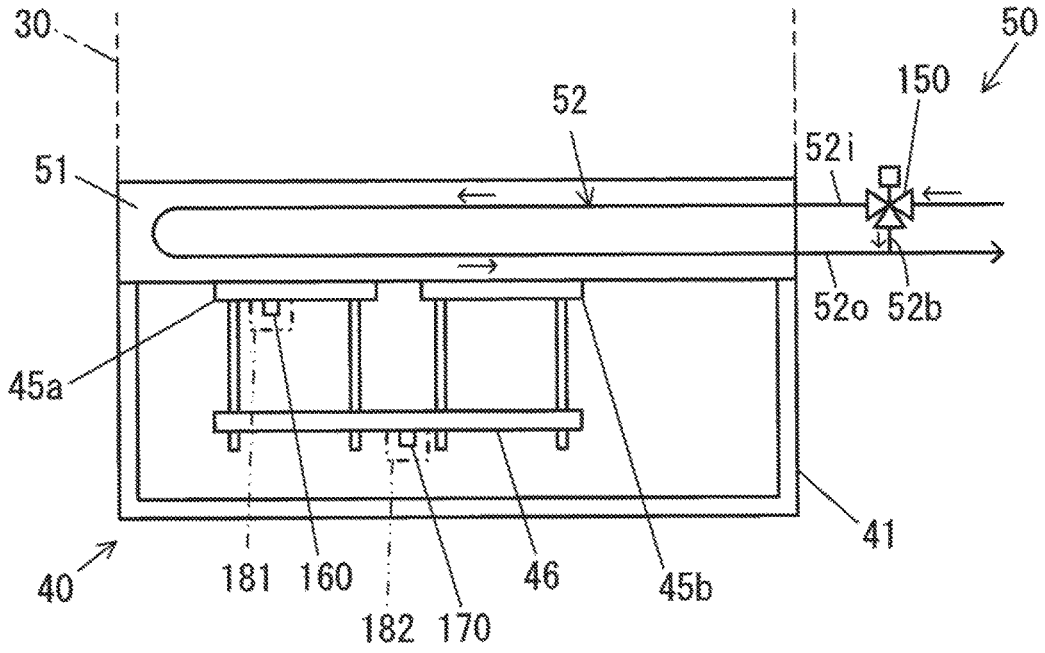
FIG. 2 is a schematic view of a temperature sensor position and a humidity sensor position in a control device according to the first embodiment.

The three-way valve 150 is an electromagnetically-driven switching valve configured to adjust the flow rate of refrigerant supplied to the cooling device 50. FIG. 2 is a schematic view of a configuration of the cooling device 50 and an internal configuration of the control device 40. FIG. 2 illustrates the positions of a temperature sensor 160 and a humidity sensor 170 in the control device 40. As illustrated in FIG. 2, the three-way valve 150 is provided at the refrigerant inlet 52*i*, and is connected to the refrigerant outlet 52*o* via a bypass flow path 52*b*.

The three-way valve 150 is switchable between a switched position (hereinafter referred to as a "supply position") at which refrigerant is supplied into the cooling block 51 and a switched position (hereinafter referred to as a "bypass position") at which supply of refrigerant into the cooling block 51 is blocked such that the refrigerant is supplied to the bypass flow path 52*b*.

A plurality of substrates 45*a*, 45*b*, 46 on which a plurality of electronic components are mounted are housed in the housing 41 of the control device 40, and each electronic component is cooled by supply of refrigerant to the cooling block 51. A power supply 151, a motor drive circuit 152, and a magnetic bearing drive circuit 153 as described later are mounted on the substrates 45*a*, 45*b*, and a main controller 140 and a three-way valve drive circuit 154 as described later are mounted on the substrate 46.

Electronic components (e.g., a field effect transistor (FET) and a diode) with a great heat generation amount are mounted on the substrates 45*a*, 45*b*. The electronic components mounted on the substrates 45*a*, 45*b* have a temperature higher than that of the electronic components mounted on the substrate 46. The substrates 45*a*, 45*b* are metal circuit boards, and are fixed to the cooling block 51 in the state in which the substrates 45*a*, 45*b* are connected so that heat can be transferred to the lower surface of the cooling block 51. Thus, the substrates 45*a*, 45*b* are efficiently cooled by supply of refrigerant into the cooling block 51. The substrate 46 is fixed to the cooling block 51 by a support member. Each substrate described herein has a two-layer structure, but may have a structure with three or more layers. The electronic component with a greater heat generation amount is preferably disposed closer to the cooling block 51. In the case where, e.g., a metal upper lid is provided on the housing 41 of the control device 40, the substrates 45*a*, 45*b* may be attached to the cooling block 51 via the upper lid, and in this manner, may be cooled.

In the housing 41 of the control device 40, the temperature sensor 160 including a heat sensitive element such as a thermistor and the resistance or electrostatic capacitance humidity sensor 170 are provided. The temperature sensor 160 is surface-mounted on the substrate 45*a*, and the humidity sensor 170 is surface-mounted on the substrate 46.

In the present specification, a position which is near the cooling block 51 in the housing 41 and which tends to have a low temperature and particularly cause dew condensation when refrigerant is supplied into the cooling block 51 is hereinafter referred to as a "low-temperature portion 181," and a position which is farther from the cooling block 51 than the low-temperature portion 181 and which tends to have a higher temperature than that of the low-temperature portion 181 is hereinafter referred to as a "high-temperature portion 182." In the present embodiment, the temperature sensor 160 is provided at the low-temperature portion 181, and the humidity sensor 170 is provided at the high-temperature portion 182.

When the humidity sensor 170 is provided at the low-temperature portion 181, there is a probability that dew condensation water adheres to the humidity sensor 170 and a humidity cannot be detected until the dew condensation water adhering to the humidity sensor 170 is evaporated. In the present embodiment, the humidity sensor 170 is provided at the high-temperature portion 182 at which dew condensation is less caused, and this can prevents dew condensation water from adhering to the humidity sensor 170.

Figure 3:
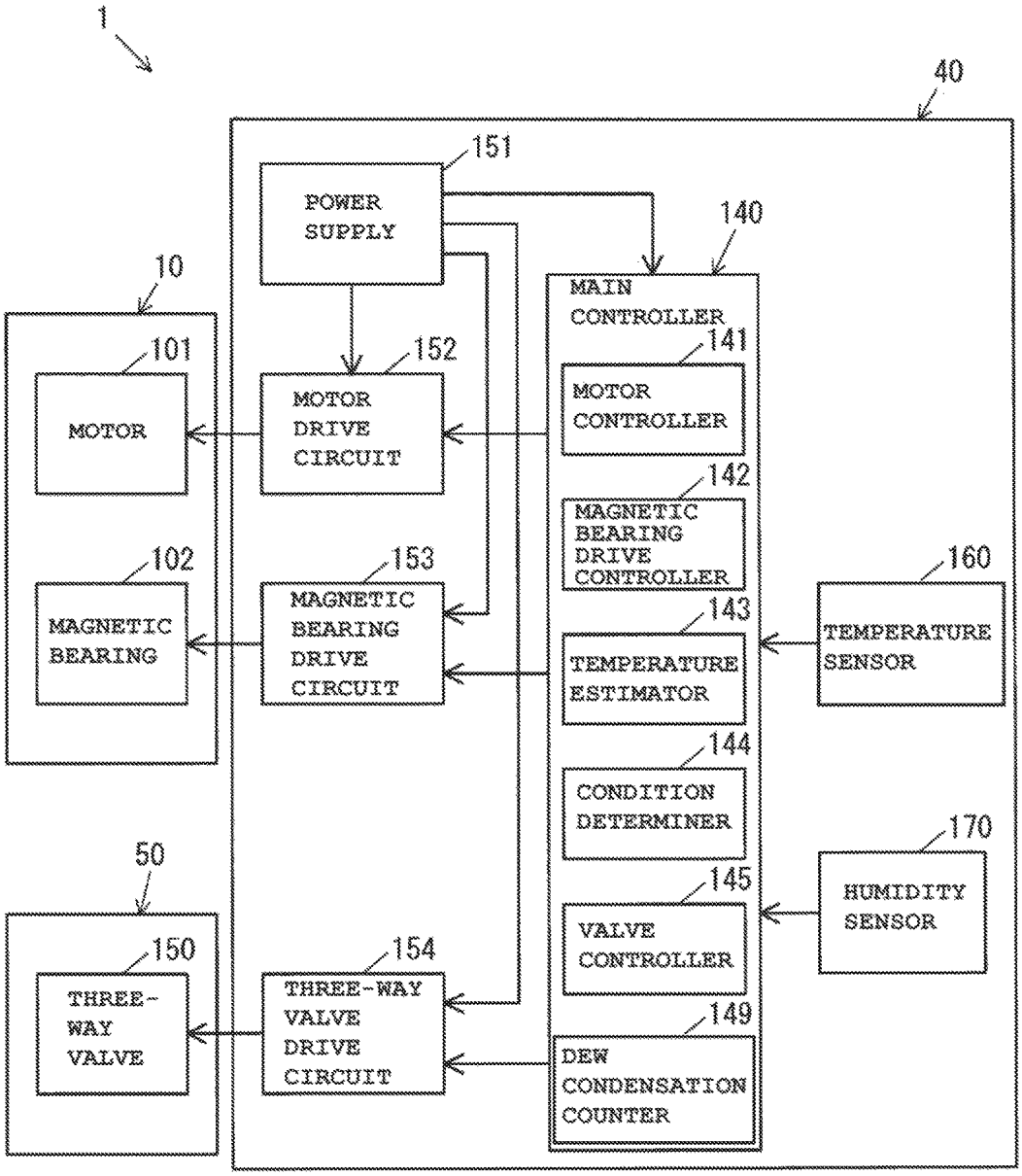
FIG. 3 is a functional block diagram of a configuration of the turbo-molecular pump.

FIG. 3 is a functional block diagram of a configuration of the turbo-molecular pump 1. The turbo-molecular pump 1 includes the main controller 140, the power supply 151, a motor 101, a magnetic bearing 102, the three-way valve 150, the temperature sensor 160, the humidity sensor 170, the motor drive circuit 152, the magnetic bearing drive circuit 153, and the three-way valve drive circuit 154.

The power supply 151 includes an AC/DC conversion circuit and a DC/DC converter. The AC/DC conversion circuit is configured to convert AC power input to the control device 40 into DC power. The DC power converted by the AC/DC conversion circuit is supplied to, e.g., the motor drive circuit 152, the magnetic bearing drive circuit 153, and the three-way valve drive circuit 154. The DC power converted by the AC/DC conversion circuit is converted into low-voltage DC power by the DC/DC converter, and then, is supplied to the main controller 140.

The main controller 140 includes a CPU, a ROM/RAM as a storage device, and an arithmetic processing device having other peripheral circuits etc., thereby controlling operation of the turbo-molecular pump 1. The main controller 140 functionally includes a motor controller 141, a magnetic bearing drive controller 142, a temperature estimator 143, a condition determiner 144, a valve controller 145, and a dew condensation counter 149.

The motor drive circuit 152 is configured to control driving of the motor 101 based on a control signal input from the motor controller 141. The magnetic bearing drive circuit 153 is configured to drive the magnetic bearing 102 based on a control signal input from the magnetic bearing drive controller 142. The three-way valve drive circuit 154 is configured to drive the three-way valve 150 based on a control signal input from the valve controller 145.

The dew condensation counter 149 is a timer configured to measure a duration time of the state of causing dew condensation and a duration time of the state of causing no dew condensation.

The temperature estimator 143 is configured to estimate the temperature of the high-temperature portion 182 based on the temperature $T_L$ of the low-temperature portion 181 detected by the temperature sensor 160. The temperature estimated by the temperature estimator 143 is hereinafter referred to as an "estimated temperature." For estimating the temperature $T_H$ of the high-temperature portion 182 from the temperature $T_L$ of the low-temperature portion 181, a relationship between the temperature $T_L$ of the low-temperature portion 181 and the temperature $T_H$ of the high-temperature portion 182 is checked in advance. Note that the relationship between the temperature $T_L$ of the low-temperature portion 181 and the temperature $T_H$ of the high-temperature portion 182 varies according to the size of the control device 40, arrangement of the electronic components as heat generation sources, etc. For example, it is assumed that the temperature $T_H$ of the high-temperature portion 182 is in such a relationship that the temperature $T_H$ of the high-temperature portion 182 is about 1.7 times higher than the temperature $T_L$ of the low-temperature portion 181. In this case, the estimated temperature $T_H$ of the high-temperature portion 182 is represented by Expression (1), where a constant $\alpha$ for temperature estimation is 1.7.

[Expression 1]

$$T_H = T_L \times \alpha \quad (1)$$

The constant $\alpha$ is stored in advance in the storage device of the main controller 140.

The condition determiner 144 is configured to determine whether a first cooling operation execution condition, a second cooling operation execution condition, or a cooling operation stop condition is satisfied.

The first cooling operation execution condition is satisfied when (Condition 1) or (Condition 2) is satisfied:

(Condition 1) a power supply switch of the turbo-molecular pump 1 in a stop state is turned on; and (Condition 2) after the cooling operation stop condition has been satisfied, the inner temperature of the housing 41 of the control device 40 is equal to or lower than a first temperature threshold T1, and the state of causing no dew condensation is continued for a time exceeding a second time threshold t2.

The cooling operation stop condition is satisfied when (Condition 3) or (Condition 4) is satisfied:

(Condition 3) after the first cooling operation execution condition has been satisfied, the state of causing dew condensation is continued for a time exceeding a first time threshold t1, and the inner temperature of the housing 41 of the control device 40 is equal to or lower than the first temperature threshold T1; and (Condition 4) after the second cooling operation execution condition has been satisfied, the inner temperature of the housing 41 of the control device 40 is equal to or lower than a second temperature threshold T2.

The second cooling operation execution condition is satisfied when (Condition 5) is satisfied:

(Condition 5) after the cooling operation stop condition has been satisfied, the inner temperature of the housing 41 of the control device 40 exceeds the first temperature threshold T1.

Note that when the relative humidity $R_H$ of the high-temperature portion 182 detected by the humidity sensor 170 is higher than a humidity threshold R0 ($R_H$>R0), the condition determiner 144 determines that the state of causing dew condensation is brought. When the relative humidity $R_H$ of the high-temperature portion 182 detected by the humidity sensor 170 is equal to or lower than the humidity threshold R0 ($R_H \leq$R0), the condition determiner 144 determines that the state of causing no dew condensation is brought.

The first temperature threshold T1 is the upper temperature limit of the inner temperature at which the control device 40 is stably operated, and is stored in advance in the storage device of the main controller 140. The first temperature threshold T1 is set to a temperature lower than an abnormal temperature informing temperature set to equal to or lower than an allowable temperature of each electronic component. The second temperature threshold T2 is the lower temperature limit of the inner temperature at which the control device 40 is stably operated, and is stored in advance in the storage device of the main controller 140. The second temperature threshold T2 is, as a temperature at which dew condensation is less caused, set to a temperature higher than a surrounding environment temperature (e.g., a room temperature).

The first time threshold t1 is set as a time until temperature distribution in the housing 41 of the control device 40 is stabilized, and the second time threshold t2 is a time set for preventing prompt occurrence of dew condensation due to refrigerant supply after dew condensation has been eliminated. The first time threshold t1 and the second time threshold t2 are, e.g., about one hour, and are stored in advance in the storage device of the main controller 140. Note that the same time can be set as the first time threshold t1 and the second time threshold t2, or different times can be set as the first time threshold t1 and the second time threshold t2.

The humidity threshold R0 can be set using the saturated vapor pressure $P_L$ of the low-temperature portion 181 and the saturated vapor pressure $P_H$ of the high-temperature portion 182, and is represented by Expression (2).

[Expression 2]

$$R0 = \frac{P_L}{P_H} \times 100 \quad (2)$$

Hereinafter, the humidity threshold R0 will be described in detail.

Figure 4:
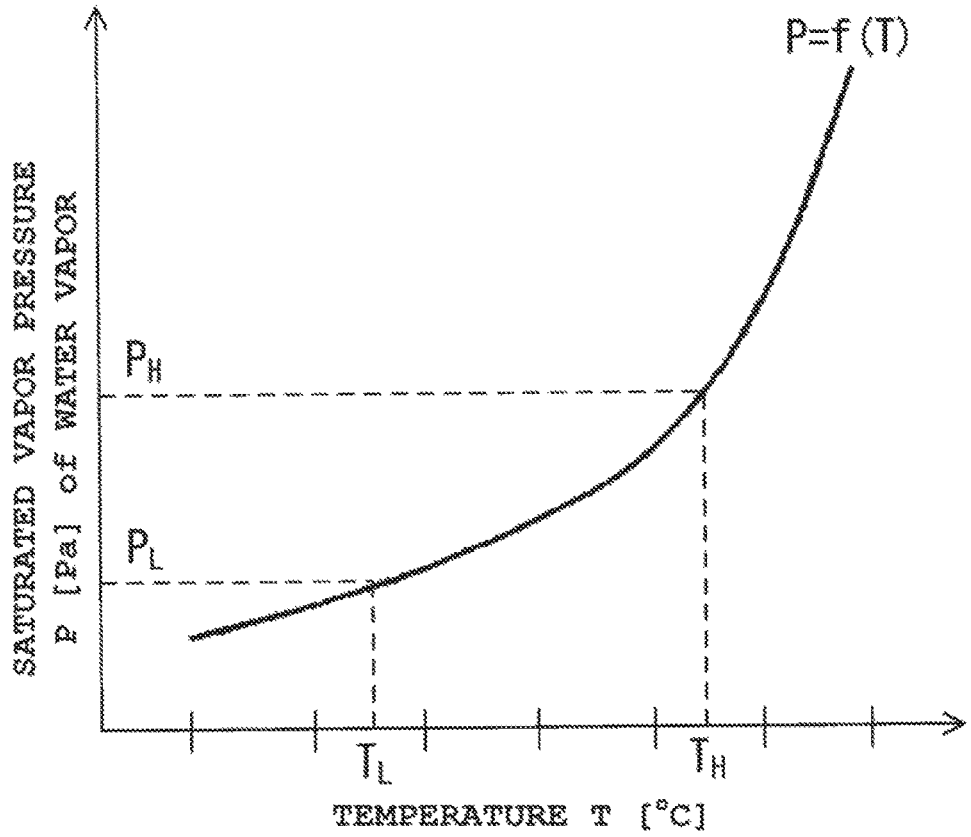
FIG. 4 is a graph of a saturated vapor pressure curve.

FIG. 4 is a graph of a saturated vapor pressure curve. The horizontal axis represents a temperature T, and the vertical axis represents the saturated vapor pressure P of water vapor. The saturated vapor pressures $P_L$, $P_H$ are obtained from the saturated vapor pressure curve. In the present embodiment, an approximate expression of the saturated vapor pressure curve is stored in advance in the storage device. Various functions f(T) as the approximate expression of the saturated vapor pressure curve have been proposed, and the function f(T) is represented by Tetens Expression (3).

[Expression 3]

$$f(T) = 6.11 \times 10^{\frac{7.5 \times T}{(T+237.3)}} \quad (3)$$

By substituting the temperature $T_L$ of the low-temperature portion 181 into Expression (3), the saturated vapor pressure $P_L$ of the low-temperature portion 181 is represented by Expression (4).

[Expression 4]

$$P_L = f(T_L) \quad (4)$$

By substituting the estimated temperature $T_H$ of the high-temperature portion 182 into Expression (3), the saturated vapor pressure $P_H$ of the high-temperature portion 182 is represented by Expression (5).

[Expression 5]

$$P_H = f(T_H) \quad (5)$$

Using Expression (6), it can be determined whether or not dew condensation is caused in the low-temperature portion 181.

[Expression 6]

$$P_O > P_L \quad (6)$$

In this expression, "$P_O$" represents a water vapor pressure in the housing 41 of the control device 40. That is, when the water vapor pressure $P_O$ is higher than the saturated vapor pressure $P_L$ of the low-temperature portion 181, it can be determined that dew condensation is caused in the low-temperature portion 181.

The relative humidity $R_H$ of the high-temperature portion 182 is represented by Expression (7).

[Expression 7]

$$R_H = \frac{P_O}{P_H} \times 100 \quad (7)$$

By substituting Expression (7) into Expression (6), Expression (8) is obtained.

[Expression 8]

$$R_H = \frac{P_L}{P_H} \times 100 \quad (8)$$

Thus, the right side of Expression (8) represents the humidity threshold R0 for determining whether or not dew condensation is caused, and the humidity threshold R0 changes, as represented by Expression (2), according to a change in the inner temperature of the housing 41 of the control device 40.

When the first cooling operation execution condition and the second cooling operation execution condition are satisfied, the valve controller 145 illustrated in FIG. 3 switches the three-way valve 150 to the supply position (i.e., operates the cooling device 50). When the cooling operation stop condition is satisfied, the valve controller 145 switches the three-way valve 150 to the bypass position (i.e., stops the cooling device 50).

Figure 5:
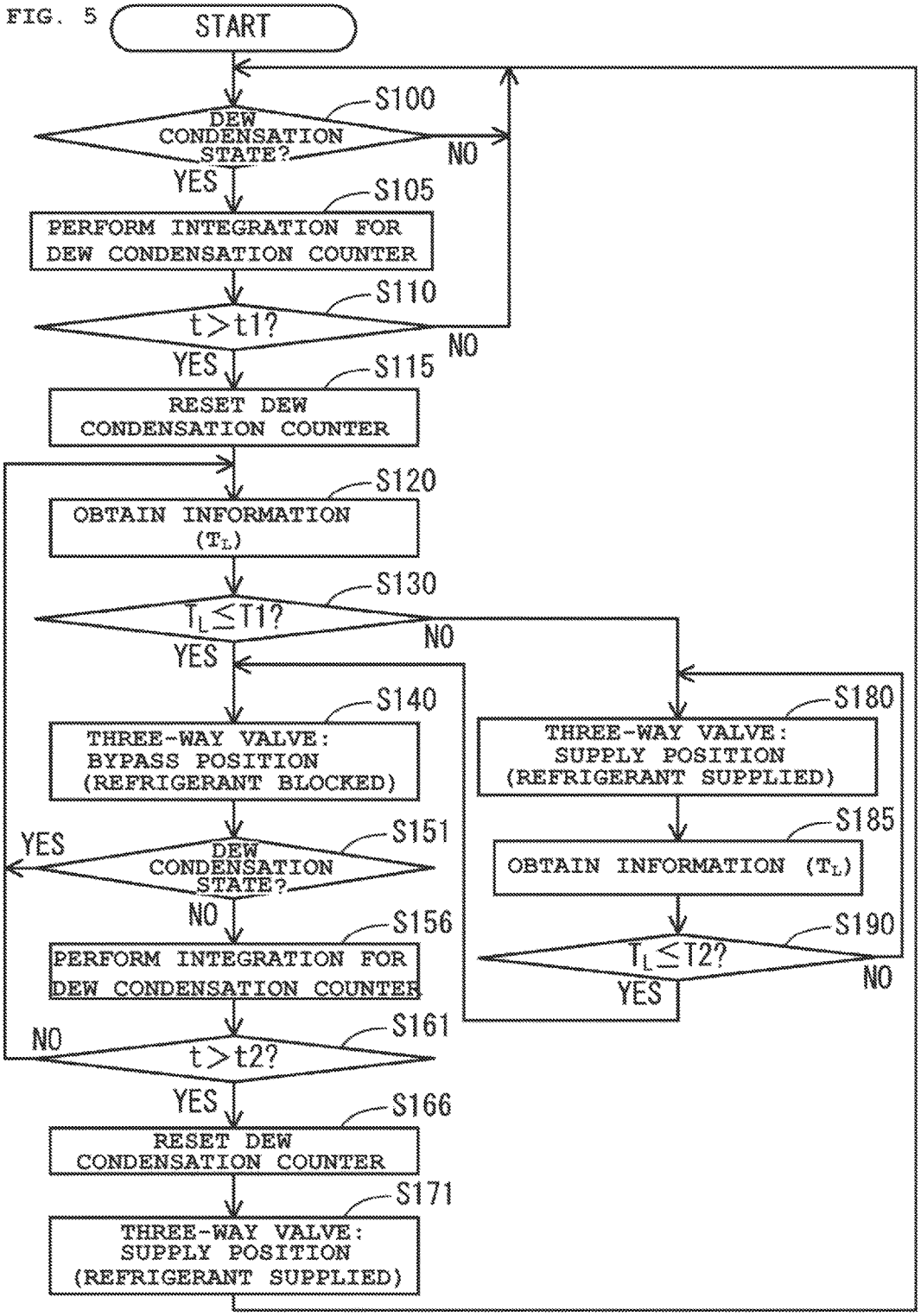
FIG. 5 is a flowchart of operation in electromagnetic valve switching processing according to the first embodiment.
Figure 6:
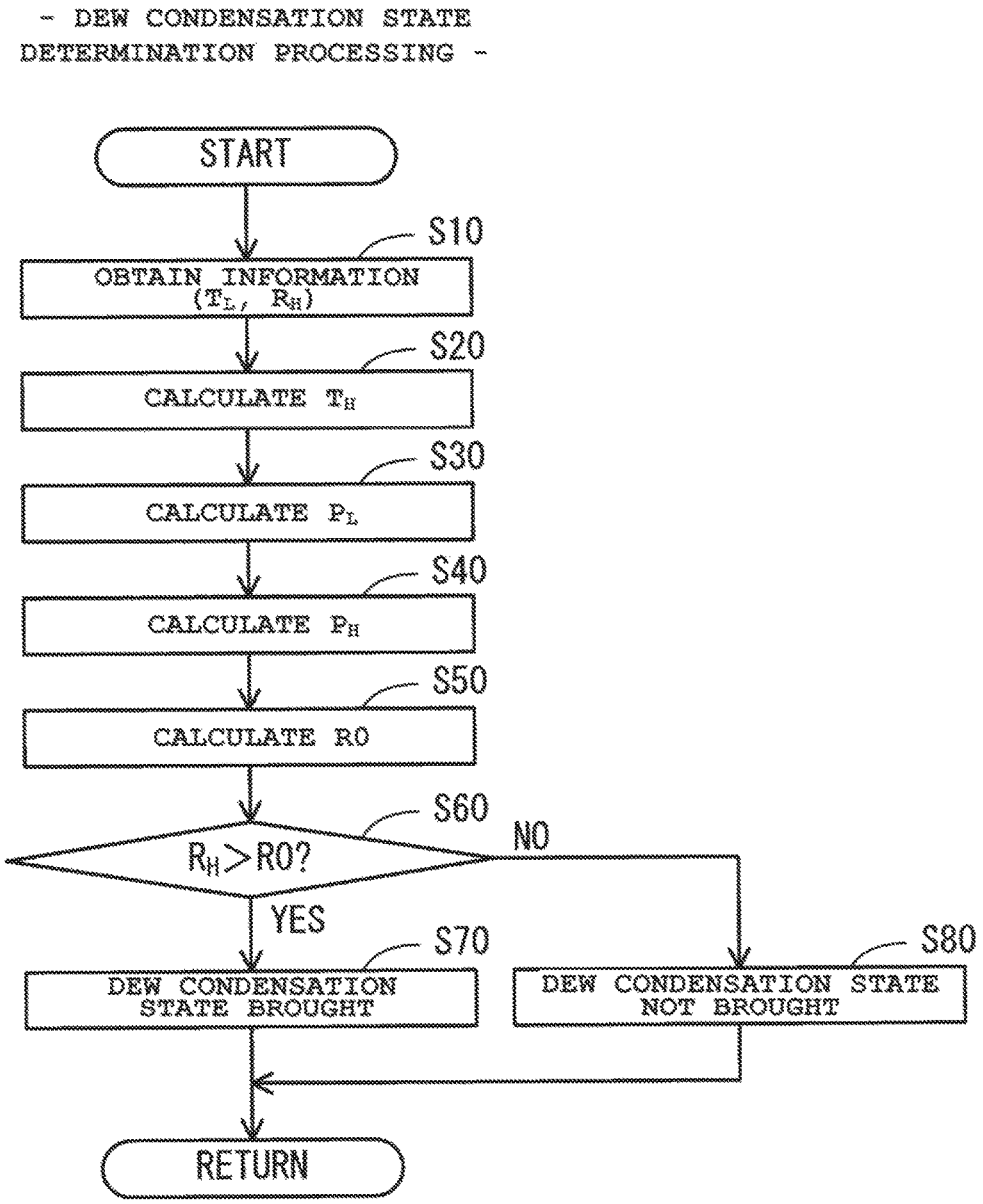
FIG. 6 is a flowchart of operation in dew condensation state determination processing according to the first embodiment.

FIG. 5 is a flowchart of operation in electromagnetic valve switching processing by the main controller 140 of the control device 40 according to the first embodiment, and FIG. 6 is a flowchart of operation in dew condensation state determination processing according to the first embodiment. When the power supply switch of the turbo-molecular pump 1 is turned on, a valve control program is executed. After not-shown initial setting, processing after a step S100 is repeatedly executed every a predetermined control cycle. In initial setting, the main controller 140 determines that the first cooling operation execution condition has been satisfied, and then, outputs a control signal for switching the three-way valve 150 to the supply position. Moreover, in initial setting, the dew condensation counter 149 is reset.

As shown in FIG. 5, the main controller 140 determines, at the step S100, whether or not dew condensation is caused. The step S100 is repeated until positive determination. Upon positive determination, the processing proceeds to a step S105. According to the processing shown in FIG. 6, it is determined whether or not dew condensation is caused.

As shown in FIG. 6, the main controller 140 obtains, at a step S10, the temperature $T_L$ of the low-temperature portion 181 and the relative humidity $R_H$ of the high-temperature portion 182 as information from the temperature sensor 160 and the humidity sensor 170. Then, the processing proceeds to a step S20.

At the step S20, the main controller 140 calculates the estimated temperature $T_H$ of the high-temperature portion 182 based on the temperature $T_L$ of the low-temperature portion 181 obtained at the step S10. Then, the processing proceeds to a step S30.

At the step S30, the main controller 140 calculates the saturated vapor pressure $P_L$ of the low-temperature portion 181 based on the temperature $T_L$ of the low-temperature portion 181 obtained by the step S10. Then, the processing proceeds to a step S40.

At the step S40, the main controller 140 calculates the saturated vapor pressure $P_H$ of the high-temperature portion 182 based on the estimated temperature $T_H$ of the high-temperature portion 182 obtained at the step S20. Then, the processing proceeds to a step S50.

At the step S50, the main controller 140 calculates the humidity threshold R0 based on the saturated vapor pressure $P_L$ of the low-temperature portion 181 obtained at the step S30 and the saturated vapor pressure $P_H$ of the high-temperature portion 182 obtained at the step S40. Then, the processing proceeds to a step S60.

At the step S60, the main controller 140 determines whether or not the relative humidity $R_H$ of the high-temperature portion 182 obtained at the step S10 is higher than the humidity threshold R0 obtained at the step S50. Upon positive determination at the step S60, the processing proceeds to a step S70. Upon negative determination at the step S60, the processing proceeds to a step S80.

At the step S70, the main controller 140 determines that dew condensation is caused, and sets a flag indicating the state of causing dew condensation. At the step S80, the main controller 140 determines that no dew condensation is caused, and sets a flag indicating the state of causing no dew condensation.

As shown in FIG. 5, when it is, at the step S100, determined that dew condensation is caused, the main controller 140 integrates the time of the dew condensation counter 149 at the step S105. Then, the processing proceeds to a step S110.

At the step S110, the main controller 140 determines whether or not the time t measured by the dew condensation counter 149 exceeds the first time threshold t1. Upon positive determination at the step S110, the processing proceeds to a step S115. Upon negative determination at the step S110, the processing returns to the step S100.

At the step S115, the main controller 140 resets the dew condensation counter 149, i.e., sets the integrated time t to zero. Then, the processing proceeds to a step S120.

At the step S120, the main controller 140 obtains, as the inner temperature of the housing 41, the temperature $T_L$ of the low-temperature portion 181 as the information from the temperature sensor 160. Then, the processing proceeds to a step S130. At the step S130, the main controller 140 determines whether or not the temperature $T_L$ is equal to or lower than the first temperature threshold T1. Upon positive determination at the step S130, the processing proceeds to a step S140. Upon negative determination at the step S130, the processing proceeds to a step S180.

At the step S140, the main controller 140 outputs a control signal for switching the three-way valve 150 to the bypass position. Then, the processing proceeds to a step S151.

At the step S151, the main controller 140 determines, as in the step S100 (the steps S10 to S80), whether or not dew condensation is caused. Upon positive determination at the step S151, the processing returns to the step S120. Upon negative determination at the step S151, the processing proceeds to a step S156.

At the step S156, the main controller 140 integrates the time of the dew condensation counter 149. Then, the processing proceeds to a step S161.

At the step S161, the main controller 140 determines whether or not the time t measured by the dew condensation counter 149 exceeds the second time threshold t2. Upon positive determination at the step S161, the processing proceeds to a step S166. Upon negative determination at the step S161, the processing returns to the step S120.

At the step S166, the main controller 140 resets the dew condensation counter 149, i.e., sets the integrated time t to zero. Then, the processing proceeds to a step S171. At the step S171, the main controller 140 outputs the control signal for switching the three-way valve 150 to the supply position. Then, the processing returns to the step S100.

When it is, at the step S130, determined that the temperature $T_L$ is higher than the first temperature threshold T1, the processing proceeds to a step S180. At the step S180, the main controller 140 outputs the control signal for switching the three-way valve 150 to the supply position. Then, the processing proceeds to a step S185.

At the step S185, the main controller 140 obtains, as the inner temperature of the housing 41, the temperature $T_L$ of the low-temperature portion 181 as the information from the temperature sensor 160. Then, the processing proceeds to a step S190. At the step S190, the main controller 140 determines whether or not the temperature $T_L$ is equal to or lower than the second temperature threshold T2. Upon positive determination at the step S190, the processing proceeds to the step S140. Upon negative determination at the step S190, the processing returns to the step S180.

Operation in the first embodiment will be summarized as follows. When a user turns on the power supply switch of the turbo-molecular pump 1, the turbo-molecular pump 1 is started. Since the first cooling operation execution condition has been satisfied, the three-way valve 150 is switched to the supply position.

When a drive switch configured to instruct driving of the motor of the turbo-molecular pump 1 is turned off, the vicinity of the cooling block 51 in the control device 40 is under a low temperature. When dew condensation is caused at the low-temperature portion 181 in the control device 40 ("Yes" at the step S100), such a state is continued for the first time threshold t1 (e.g., one hour) ("Yes" at the step S110), and the inner temperature of the housing 41 of the control device 40 is equal to or lower than the first temperature threshold T1 ("Yes" at the step S130), the cooling operation stop condition is satisfied. Thus, the three-way valve 150 is switched to the bypass position, and supply of refrigerant to the cooling block 51 is blocked (step S140).

In the state in which supply of refrigerant to the cooling block 51 is blocked, i.e., the state in which the cooling device 50 is stopped, when the motor rotates, the temperature of the control device 40 gradually increases. When the inner temperature of the housing 41 of the control device 40 exceeds the first temperature threshold T1 ("No" at the step S130), the second cooling operation execution condition is satisfied. Thus, the three-way valve 150 is switched to the supply position, and refrigerant is supplied to the cooling block 51 (step S180).

When refrigerant is supplied to the cooling block 51, the temperature of the control device 40 gradually decreases. When the inner temperature of the control device 40 is higher than the second temperature threshold T2, dew condensation is less caused, and therefore, refrigerant supply is continued ("No" at the step S190).

When the motor drive switch is turned off to stop rotation of the motor 101 and the temperature of the control device 40 reaches equal to or lower than the second temperature threshold T2 ("Yes" at the step S190), the cooling operation stop condition is satisfied. Thus, the three-way valve 150 is switched to the bypass position, and supply of refrigerant to the cooling block 51 is blocked (step S140). That is, when cooling operation is once executed due to a temperature increase, the cooling operation is, regardless of whether or not dew condensation is caused, continuously executed until the inner temperature of the control device 40 reaches equal to or lower than the second temperature threshold T2.

When a temperature increase in the state in which supply of refrigerant to the cooling block 51 is blocked is slow or constant and the inner temperature of the housing 41 of the control device 40 is equal to or lower than the first temperature threshold T1 ("Yes" at the step S130), if the state of causing no dew condensation is continued for the second time threshold t2 (e.g., one hour) ("Yes" at the step S161), the first cooling operation execution condition is satisfied.

Thus, the three-way valve 150 is switched to the supply position, and refrigerant is supplied to the cooling block 51 (step S171).

As described above, according to the present embodiment, execution and stop of the cooling operation are controlled based on a dew condensation occurrence state and the inner temperature of the housing 41. Thus, e.g., reduction in occurrence of dew condensation and prevention of occurrence of malfunction due to dew condensation can be realized while an increase in the temperature of the control device 40 can be effectively suppressed.

According to the above-described first embodiment, the following features and advantageous effects are provided.

(1) The main controller 140 is provided, which is configured to estimate the temperature $T_H$ of the high-temperature portion 182 based on the temperature $T_L$ of the low-temperature portion 181 detected by the temperature sensor 160 and to control execution and stop of the cooling operation of the cooling device 50 based on the estimated temperature $T_H$ of the high-temperature portion 182, the temperature $T_L$ of the low-temperature portion 181 detected by the temperature sensor 160, and the relative humidity $R_H$ of the high-temperature portion 182 detected by the humidity sensor 170.

The types of detection information required for controlling the cooling operation are reduced to two types. Thus, as compared to the case of detecting three or more types of information to control the cooling operation, the probability of occurrence of erroneous detection can be more reduced, and reliability in determination of a dew condensation state can be more improved.

(2) As compared to a technique (hereinafter referred to as a "typical technique") described in Patent Literature 1, the number of sensors can be more reduced, leading to a lower cost and a smaller weight.

(3) The temperature sensor 160 is surface-mounted on the metal substrate 45*a* which is connected so that heat can be transferred to the cooling block 51 forming the cooling flow path. With this configuration, a size and a cost can be more reduced as compared to the case of directly fixing a temperature sensor to the cooling block 51. In the case of directly attaching the temperature sensor to the cooling block 51, an attachment tool for screwing etc. and a harness dedicated for connecting the temperature sensor and a substrate together need to be provided. On the other hand, in the present embodiment, the temperature sensor 160 including the heat sensitive element such as the thermistor is surface-mounted on the substrate 45*a*, and therefore, no attachment tool and no dedicated harness are required.

(4) The condition where the state of causing dew condensation is continued for a predetermined time t1 is employed as the condition for determining satisfaction of the cooling operation stop condition. The predetermined time described herein is set as a time indicating stable temperature distribution in the housing 41 of the control device 40. With this configuration, occurrence of dew condensation can be determined in the state in which the temperature distribution in the housing 41 is stable. This prevents erroneous determination of the dew condensation state in an unstable state.

(5) Refrigerant is supplied after the state of causing no dew condensation has been continued for a predetermined time t2. The predetermined time t2 described herein is set as a time for preventing prompt occurrence of dew condensation due to refrigerant supply after dew condensation has been eliminated. In the case of not determining whether or not the state of causing no dew condensation has been continued for the predetermined time t2, the three-way valve 150 is promptly switched to the supply position after it has been determined that no dew condensation is caused (step S171). Accordingly, the low-temperature portion 181 is cooled, leading to the probability that dew condensation is promptly caused. On the other hand, in the present embodiment, refrigerant is supplied after the state of causing no dew condensation has been continued for the predetermined time t2. This prevents prompt occurrence of dew condensation due to refrigerant supply after elimination of dew condensation, and a stable state can be maintained without occurrence of dew condensation.

(6) When operation of the cooling device 50 is stopped, if the inner temperature of the housing 41 of the control device 40 reaches higher than the first temperature threshold T1, the cooling operation is executed ("No" at the step S130). With this configuration, an increase in the temperature of the control device 40 can be suppressed, and stop of operation or equipment of an informing device such as an alarm configured to inform an abnormal temperature due to a temperature increase can be prevented.

(7) When the cooling operation is executed, the cooling operation is, regardless of whether or not dew condensation is caused, executed until the inner temperature of the housing 41 reaches lower than the second temperature threshold T2 lower than the first temperature threshold T1 ("No" at the step S190). When the inner temperature of the housing 41 reaches lower than the second temperature threshold T2, the cooling operation is stopped ("Yes" at the step S190). Note that the second temperature threshold T2 is set higher than the surrounding environment temperature. Thus, when the inner temperature of the housing 41 is higher than the second temperature threshold T2, even if temperature information or relative humidity information from which it is determined that dew condensation is caused is detected, the cooling operation is continuously executed. Thus, stop of the cooling operation due to erroneous detection of the temperature information or the relative humidity information can be prevented.

Second Embodiment

Figure 7:
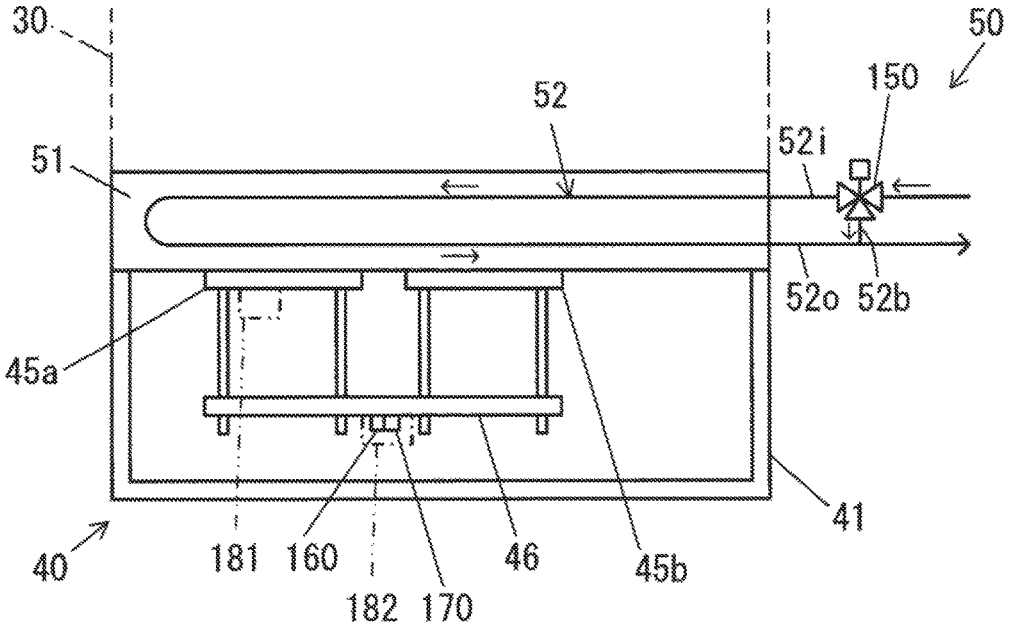
FIG. 7 is a schematic view of a temperature sensor position and a humidity sensor position in a control device according to a second embodiment.

A turbo-molecular pump 1 of a second embodiment will be described with reference to FIGS. 7 and 8. The turbo-molecular pump 1 of the second embodiment has a configuration similar to that of the first embodiment. Note that in the figures, the same reference numerals as those of the first embodiment are used to represent the same or equivalent elements, and differences will be mainly described. FIG. 7 is a view similar to FIG. 2, and is a schematic view of the positions of a temperature sensor 160 and a humidity sensor 170 in a control device 40 according to the second embodiment.

In the first embodiment, the example where the temperature sensor 160 is disposed at the low-temperature portion 181 has been described (see FIG. 2). On the other hand, in the second embodiment, the temperature sensor 160 is disposed at a high-temperature portion 182, and the temperature $T_H$ of the high-temperature portion 182 is detected by the temperature sensor 160.

In the second embodiment, a temperature estimator 143 illustrated in FIG. 3 estimates the temperature $T_L$ of a low-temperature portion 181 based on the temperature $T_H$ of the high-temperature portion 182 detected by the temperature sensor 160. The estimated temperature $T_L$ of the low-temperature portion 181 is represented by Expression (9) as a modified form of Expression (1).

[Expression 9]

$$T_L = T_H \div \alpha \quad (9)$$

In this expression, "α" represents a constant for temperature estimation, and α=1.7 in the present embodiment. The constant α is stored in advance in a storage device of a main controller 140.

Figure 8:
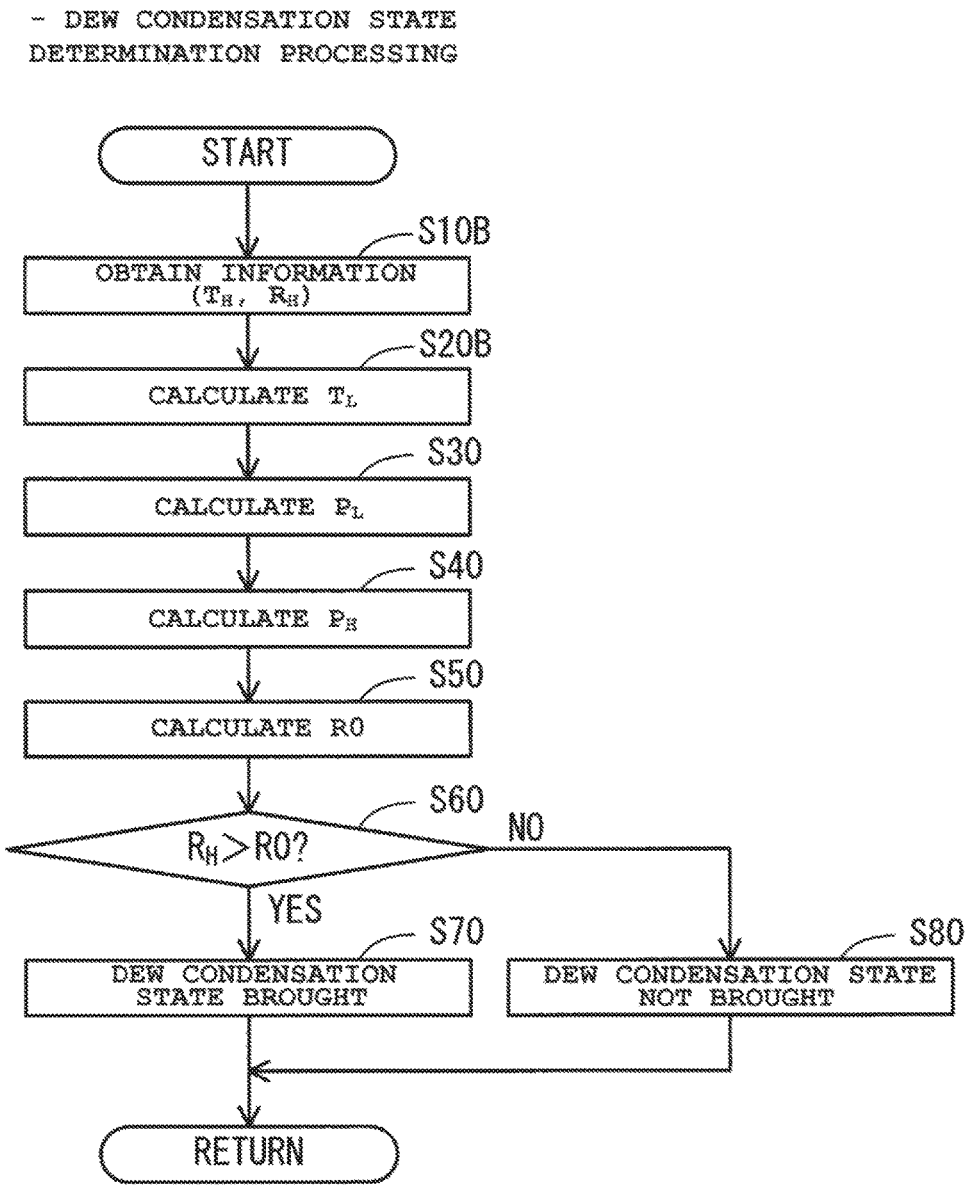
FIG. 8 is a flowchart of operation in dew condensation state determination processing according to the second embodiment.

FIG. 8 is a flowchart of operation in dew condensation state determination processing according to the second embodiment. Instead of the steps S10 and S20 in the flowchart of FIG. 6, steps S10B and S20B are added.

As shown in FIG. 8, in the second embodiment, the main controller 140 obtains, at the step S10B, the temperature $T_H$ of the high-temperature portion 182 and the relative humidity $R_H$ of the high-temperature portion 182 as information from the temperature sensor 160 and the humidity sensor 170. Then, the processing proceeds to the step S20B.

At the step S20B, the main controller 140 calculates the estimated temperature $T_L$ of the low-temperature portion 181 based on the temperature $T_H$ of the high-temperature portion 182 obtained at the step S10B. Then, the processing proceeds to a step S30.

As described above, in the second embodiment, it is configured such that the flow of refrigerant in a cooling flow path is controlled by determination of a dew condensation state based on the temperature $T_H$ of the high-temperature portion 182 detected by the temperature sensor 160, the relative humidity $R_H$ of the high-temperature portion 182 detected by the humidity sensor 170, and the estimated temperature $T_L$ of the low-temperature portion 181.

According to the second embodiment, features and advantageous effects similar to those of the first embodiment are provided.

Third Embodiment

Figure 9:
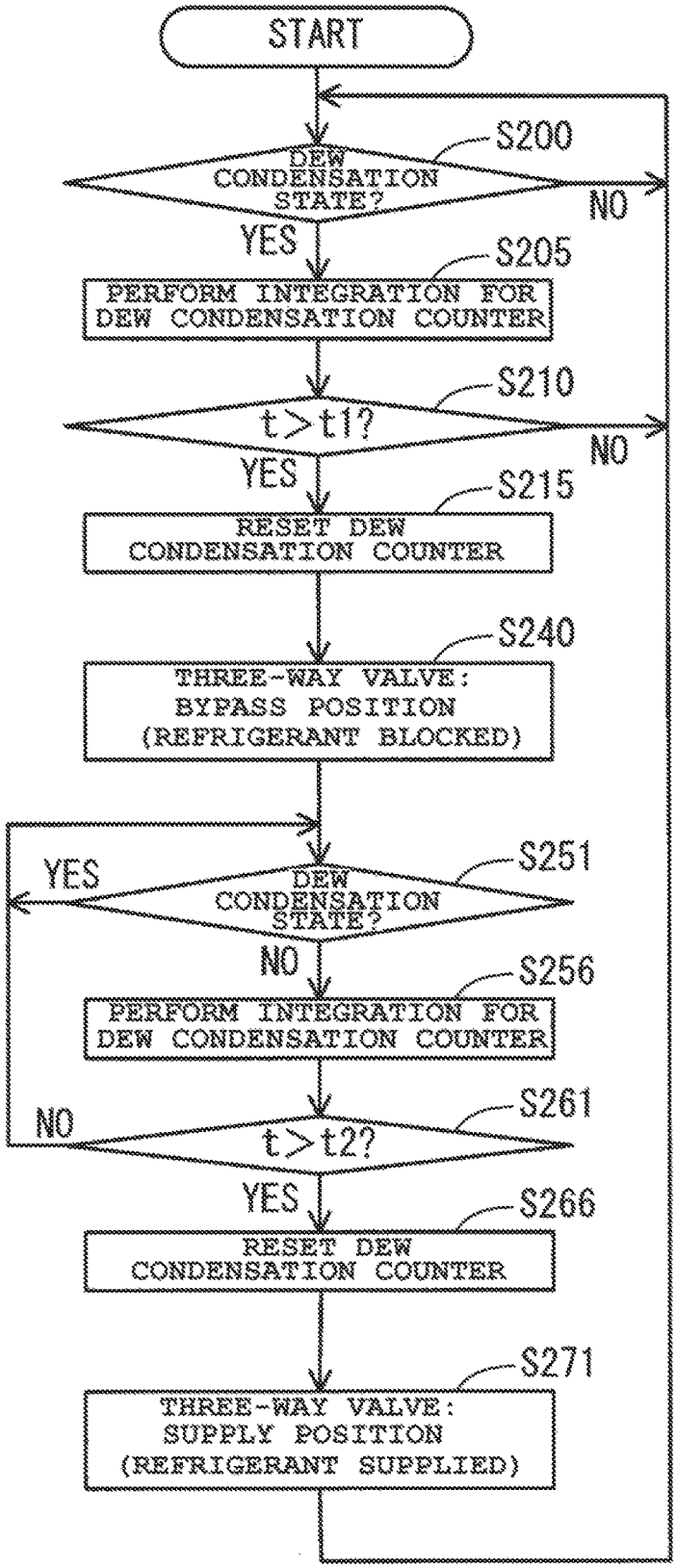
FIG. 9 is a flowchart of operation in electromagnetic valve switching processing according to a third embodiment.

A turbo-molecular pump 1 of a third embodiment will be described with reference to FIG. 9. The turbo-molecular pump 1 of the third embodiment has a configuration similar to that of the first embodiment. Hereinafter, differences from the first embodiment will be described. FIG. 9 is a flowchart of operation in electromagnetic valve switching processing according to the third embodiment.

In the first embodiment, the control of switching the three-way valve 150 is executed considering the inner temperature of the housing 41 of the control device 40. On the other hand, in the third embodiment, the control of switching a three-way valve 150 is, regardless of the inner temperature of a housing 41 of a control device 40, executed based on whether or not dew condensation is caused. Specific description will be made below.

A condition determiner 144 illustrated in FIG. 3 determines whether a cooling operation execution condition or a cooling operation stop condition is satisfied.

The cooling operation execution condition is satisfied when (Condition 1C) or (Condition 2C) is satisfied:

(Condition 1C) a power supply switch of the turbo-molecular pump 1 is turned on in a stop state; and (Condition 2C) after the cooling operation stop condition has been satisfied, the state of causing no dew condensation is continued for a time exceeding a second time threshold t2.

The cooling operation stop condition is satisfied when (Condition 3C) is satisfied:

(Condition 3C) after the cooling operation execution condition has been satisfied, the state of causing dew condensation is continued for a time exceeding a first time threshold t1.

Processing at steps S200, S205, S210, S215 as shown in FIG. 9 is similar to that at the steps S100, S105, S110, S115 as shown in FIG. 5. Moreover, processing at steps S240, S251, S256, S261, S266, S271 as shown in FIG. 9 is similar to that at the steps S140, S151, S156, S161, S166, S171 as shown in FIG. 5. That is, the flowchart of FIG. 9 shows the processing excluding the steps S120, S130, S180, S185, S190 from the flowchart of FIG. 5.

Upon completion of the processing at the step S215, the processing proceeds to the step S240. As in the step S140, the main controller 140 executes the control of switching the three-way valve 150 to a bypass position. Then, the processing proceeds to the step S251.

At the step S251, the main controller 140 determines whether or not dew condensation is caused. The step S251 is repeated until negative determination. Upon negative determination, the processing proceeds to the step S256. According to the processing shown in FIG. 6, it is determined whether or not dew condensation is caused.

When it is, at the step S251, determined that no dew condensation is caused, the main controller 140 integrates a time of a dew condensation counter 149 at the step S256. Then, the processing proceeds to the step S261.

At the step S261, the main controller 140 determines whether or not the time t measured by the dew condensation counter 149 exceeds the second time threshold t2. Upon positive determination at the step S261, the processing proceeds to the step S266. Upon negative determination at the step S261, the processing returns to the step S251.

At the step S266, the main controller 140 resets the dew condensation counter 149, i.e., sets the integrated time t to zero. Then, the processing proceeds to the step S271. At the step S271, the main controller 140 outputs a control signal for switching the three-way valve 150 to a supply position as in the step S171. Then, the processing proceeds to the step S200.

According to the above-described third embodiment, features and advantageous effects similar to (1) to (5) described in the first embodiment are provided.

The following variations also fall within the scope of the present invention, and one or more of the variations may be combined with the above-described embodiments.

(First Variation)

In the above-described embodiments, the example where the constant α is used as the value for temperature estimation has been described. However, the present invention is not limited to such an example.

(Variation 1-1)

For example, a constant suitable for an operation state of the turbo-molecular pump 1 may be selected from multiple constants based on the operation state. The relationship between the temperature of the low-temperature portion 181 and the temperature of the high-temperature portion 182 is different between the case where refrigerant is supplied into the cooling block 51, i.e., the case where the cooling operation is executed, and the case where supply of refrigerant into the cooling block 51 is blocked, i.e., the case where the cooling operation is stopped. Thus, the relationship between the temperature of the low-temperature portion 181 and the temperature of the high-temperature portion 182 is preferably checked in advance for each switched position of the three-way valve 150.

A difference between the temperature of the low-temperature portion 181 and the temperature of the high-temperature portion 182 is greater in execution of the cooling operation than in stop of the cooling operation. For example, it is assumed that the temperature of the high-temperature portion 182 in the operation state in which refrigerant is supplied into the cooling block 51 is in such a relationship that such a temperature is about 1.7 times higher than the temperature of the low-temperature portion 181 and that the temperature of the high-temperature portion 182 in the operation state in which supply of refrigerant into the cooling block 51 is blocked is in such a relationship that such a temperature is about 1.3 times higher than the temperature of the low-temperature portion 181.

In this case, a first constant $\alpha 1$ of 1.7 and a second constant $\alpha 2$ of 1.3 are stored in advance in the storage device of the main controller 140. When the three-way valve 150 is switched to the supply position, the main controller 140 selects the first constant $\alpha 1$ as the constant $\alpha$ for temperature estimation ($\alpha=\alpha 1$), and estimates the temperature according to Expressions (1) and (9). When the three-way valve 150 is switched to the bypass position, the main controller 140 selects the second constant $\alpha 2$ as the constant $\alpha$ for temperature estimation ($\alpha=\alpha 2$), and estimates the temperature according to Expressions (1) and (9).

According to (Variation 1-1) described above, the following features and advantageous effects are provided in addition to features and advantageous effects similar to those of the first embodiment.

(8) When the cooling operation is executed, the main controller 140 estimates the temperature such that a difference between the temperature $T_H$ (or $T_L$) detected by the temperature sensor 160 and the estimated temperature $T_L$ (or $T_H$) is greater than in the case where the cooling operation is stopped. With this configuration, the accuracy of temperature estimation can be improved, and therefore, the accuracy of estimation of the dew condensation state can be improved.

(Variation 1-2)

When the load of the motor 101 configured to drive the pump main body 10 of the turbo-molecular pump 1 is higher than a predetermined load, the temperature may be estimated such that the difference between the temperature detected by the temperature sensor 160 and the estimated temperature is greater than in the case where the load of the motor 101 is lower than the predetermined load. For example, the following configuration may be employed: it is detected whether the motor is rotatably driven or stopped; and when the motor is rotatably driven, the temperature is estimated such that the difference between the temperature detected by the temperature sensor 160 and the estimated temperature is greater than in the case where the motor is stopped. According to (Variation 1-2) described above, the temperature suitable for the operation state can be estimated as in (Variation 1-1), and therefore, the accuracy of estimation of the dew condensation state can be improved.

(Variation 1-3)

Instead of using the constant as the value $\alpha$ for temperature estimation, a variable may be used. For example, a function $\alpha(T)$ according to the temperature detected by the temperature sensor 160 may be used as the value for temperature estimation. According to (Variation 1-3) described above, the temperature suitable for the operation state can be estimated as in (Variation 1-1), and therefore, the accuracy of estimation of the dew condensation state can be improved.

(Variation 1-4)

Power consumption of the motor may be calculated, and the value $\alpha$ for temperature estimation may be set such that a greater power consumption results in a greater difference between the temperature detected by the temperature sensor 160 and the estimated temperature. According to (Variation 1-4) described above, the temperature suitable for the operation state can be estimated as in (Variation 1-1), and therefore, the accuracy of estimation of the dew condensation state can be improved.

(Second Variation)

In the first embodiment, the example where the temperature detected at the low-temperature portion 181 is multiplied by the constant $\alpha$ for the purpose of estimating the temperature of the high-temperature portion 182 has been described. In the second embodiment, the example where the temperature detected at the high-temperature portion 182 is divided by the constant $\alpha$ for the purpose of estimating the temperature of the low-temperature portion 181 has been described. However, the present invention is not limited to these examples. Instead of multiplication or division using the constant $\alpha$, addition may be, using a constant $\beta$, performed for the temperature detected at the low-temperature portion 181 for the purpose of estimating the temperature of the high-temperature portion 182, or subtraction may be, using the constant $\beta$, performed for the temperature detected at the high-temperature portion 182 for the purpose of estimating the temperature of the low-temperature portion 181. The method for more accurately estimating the temperature is preferably employed according to the relationship between the temperature of the low-temperature portion 181 and the temperature of the high-temperature portion 182, the relationship varying according to, e.g., the shape and size of the control device 40 and arrangement of the electronic components.

(Third Variation)

In the above-described embodiments, the example where the three-way valve 150 switches between supply of refrigerant to the cooling block 51 and bypassing of refrigerant has been described. However, the present invention is not limited to such an example. Instead of the three-way valve 150, an electromagnetic on-off valve configured to switch between supply of refrigerant to the cooling block 51 and blocking of refrigerant may be employed.

(Fourth Variation)

In the above-described embodiments, blocking of refrigerant supply to the cooling block 51, i.e., a zero flow rate of refrigerant supplied to the cooling block 51, has been described as stop of the cooling operation. However, the present invention is not limited to such description. As long as the flow rate of supplied refrigerant is reduced as compared to that in execution of the cooling operation so that the state of causing no dew condensation can be brought again, such a refrigerant flow rate means that the cooling operation is stopped even when refrigerant is supplied.

(Fifth Variation)

In the above-described embodiments, the configuration in which the control device 40 is disposed below the pump main body 10 has been described. However, the present invention is not limited to such a configuration. For example, the control device 40 may be disposed at the side of the lower casing 30 of the pump main body 10. Moreover, the present invention is not limited to the case of an integrated structure of the pump main body 10 and the control device 40, and the pump main body 10 and the control device 40 may be separately arranged and used. In this case, the cooling device 50 is provided for each of the control device 40 and the pump main body 10.

(Sixth Variation)

The following example has been described in the above-described embodiments: it is, at the step S130, determined whether or not the temperature $T_L$ of the low-temperature portion 181 as the inner temperature of the housing 41 is equal to or lower than the first temperature threshold T1, and it is, at the step S190, determined whether or not the temperature $T_L$ of the low-temperature portion 181 is equal to or lower than the second temperature threshold T2. However, the present invention is not limited to such an example. Instead of the temperature $T_L$ of the low-temperature portion 181, the temperature $T_H$ of the high-temperature portion 182 may be compared with a predetermined threshold. Instead of the temperature $T_L$ of the low-temperature portion 181, an average of the temperature $T_L$ of the low-temperature portion 181 and the temperature $T_H$ of the high-temperature portion 182 may be compared with a predetermined threshold.

(Seventh Variation)

The present invention is not limited to the case where water is used as refrigerant as in the above-described embodiments, and various types of coolant can be used as refrigerant.

(Eighth Variation)

In the above-described embodiments, the cooling device 50 configured such that refrigerant flows through the cooling pipe 52 has been described as an example. However, the present invention is not limited to such an example. For example, a cooling device configured to cool the cooling block 51 with cooling air generated by a cooling fan may be employed. The flow rate of cooling air can be controlled, and therefore, the control device 40 can be cooled while occurrence of dew condensation is reduced.

(Ninth Variation)

In the above-described embodiments, the example where the turbo-molecular pump is employed as the vacuum pump has been described. However, the present invention is not limited to such an example. The present invention is applicable to various vacuum pumps. For example, the present invention is applicable to a vacuum pump including only a drag pump such as a Siegbahn pump or a Holweck pump.

The present invention is not limited to the above-described embodiments without impairing the features of the present invention, and other embodiments conceivable within the scope of the technical idea of the present invention are included in the scope of the present invention.

What is claimed is:

1. A vacuum pump control device comprising:

a pump controller configured to control a vacuum pump;

a cooling device configured to cool the pump controller;

a housing configured to house the pump controller;

a temperature sensor configured to detect, in the housing, a temperature at a first position near the cooling device;

a humidity sensor configured to detect a humidity at a second position in the housing, the second position having a higher temperature than that at the first position;

a temperature estimator configured to estimate a temperature at the second position based on the temperature detected by the temperature sensor;

a cooling controller configured to control execution and stop of a cooling operation by the cooling device based on the temperature estimated by the temperature estimator, the temperature detected by the temperature sensor, and the humidity detected by the humidity sensor; and a storage device storing a first constant indicating a relationship between the temperature at the first position and the temperature at the second position when the cooling operation is executed, and a second constant indicating a relationship between the temperature at the first position and the temperature at the second position when the cooling operation is stopped, the second constant is smaller than the first constant, wherein when the cooling operation is executed, the temperature estimator estimates the temperature at the second position in such a manner that multiplication or addition is, using the first constant stored by the storage device, performed for the temperature detected at the first position by the temperature sensor, and when the cooling operation is stopped, the temperature estimator estimates the temperature at the second position in such a manner that multiplication or addition is, using the second constant stored by the storage device, performed for the temperature detected at the first position by the temperature sensor.

2. The vacuum pump control device according to claim 1, wherein the cooling controller includes a condition determiner configured to determine that a dew condensation state has occurred when the humidity is higher than a predetermined humidity and determine that the dew condensation state has not occurred when the humidity is lower than the predetermined humidity, and an operation controller configured to stop the cooling operation when a state determined as the dew condensation state is continued for a predetermined time, the predetermined time is set as a time which represents stable temperature distribution in the housing, and when the cooling operation is stopped, if the temperature in the housing reaches higher than the first temperature, the operation controller executes the cooling operation.

3. The vacuum pump control device according to claim 2, wherein the operation controller executes, regardless of whether or not the dew condensation state is brought, the cooling operation until the temperature in the housing reaches lower than a second temperature lower than the first temperature when the cooling operation is executed, and stops the cooling operation when the temperature in the housing reaches lower than the second temperature.

4. The vacuum pump control device according to claim 1, wherein the cooling device includes a flow path formation body forming a cooling flow path through which refrigerant for cooling the pump controller circulates, a metal substrate is connected to the flow path formation body so that heat can be transferred, and the temperature sensor is surface-mounted on the substrate at the first position.

5. The vacuum pump control device according to claim 1, wherein the temperature estimator estimates the temperature at the second position in such a manner that multiplication or addition is, using a constant, performed for the temperature detected at the first position by the temperature sensor.

6. The vacuum pump control device according to claim 1, wherein the temperature sensor is mounted on a substrate connected to the cooling device.

7. A vacuum pump control device comprising:

a pump controller configured to control a vacuum pump;

a cooling device configured to cool the pump controller;

a housing configured to house the pump controller;

a temperature sensor configured to detect, in the housing, a temperature at a first position near the cooling device;

a humidity sensor configured to detect a humidity at a second position in the housing, the second position having a higher temperature than that at the first position;

a temperature estimator configured to estimate a temperature at the second position based on the temperature detected by the temperature sensor;

a cooling controller configured to control execution and stop of a cooling operation by the cooling device based on the temperature estimated by the temperature estimator, the temperature detected by the temperature sensor, and the humidity detected by the humidity sensor; and a storage device storing a first constant indicating a relationship between the temperature at the first position and the temperature at the second position when a load of a motor configured to drive the vacuum pump is higher than a predetermined load, and a second constant indicating a relationship between the temperature at the first position and the temperature at the second position when the load of the motor is lower than the predetermined load, the second constant is smaller than the first constant, wherein when the load of the motor is higher than a predetermined load, the temperature estimator estimates the temperature at the second position in such a manner that multiplication or addition is, using the first constant stored by the storage device, performed for the temperature detected at the first position by the temperature sensor, and when the load of the motor is lower than the predetermined load, the temperature estimator estimates the temperature at the second position in such a manner that multiplication or addition is, using the second constant stored by the storage device, performed for the temperature detected at the first position by the temperature sensor.

8. A vacuum pump control device comprising:

a pump controller configured to control a vacuum pump;

a cooling device configured to cool the pump controller;

a housing configured to house the pump controller;

a temperature sensor configured to detect, in the housing, a temperature at a first position near the cooling device;

a humidity sensor configured to detect a humidity at a second position in the housing, the second position having a higher temperature than that at the first position;

a temperature estimator configured to estimate a temperature at the second position based on the temperature detected by the temperature sensor; and a cooling controller configured to control execution and stop of a cooling operation by the cooling device based on the temperature estimated by the temperature estimator, the temperature detected by the temperature sensor, and the humidity detected by the humidity sensor, wherein the cooling controller includes a condition determiner configured to determine that a dew condensation state has occurred when the humidity is higher than a predetermined humidity and determine that the dew condensation state has not occurred when the humidity is lower than the predetermined humidity, and determine whether a first cooling operation execution condition, a second cooling operation execution condition, or a cooling operation stop condition is satisfied, and an operation controller configured to execute the cooling operation when the first cooling operation execution condition or the second cooling operation execution condition is satisfied, and to stop the cooling operation when the cooling operation stop condition is satisfied, wherein the first cooling operation execution condition is satisfied when (Condition 1) or (Condition 2) is satisfied:

(Condition 1) a power supply of the vacuum pump in a stop state is turned on;

(Condition 2) after the cooling operation stop condition has been satisfied, the temperature detected by the temperature sensor is equal to or lower than a first temperature threshold T1, and the state of no dew condensation is continued for a time exceeding a second time threshold t2, the cooling operation stop condition is satisfied when (Condition 3) or (Condition 4) is satisfied:

(Condition 3) after the first cooling operation execution condition has been satisfied, the state of dew condensation is continued for a time exceeding a first time threshold t1, and the temperature detected by the temperature sensor is equal to or lower than the first temperature threshold T1; and (Condition 4) after the second cooling operation execution condition has been satisfied, the temperature detected by the temperature sensor is equal to or lower than a second temperature threshold T2, the second cooling operation execution condition is satisfied when (Condition 5) is satisfied:

(Condition 5) after the cooling operation stop condition has been satisfied, the temperature detected by the temperature sensor exceeds the first temperature threshold T1, and the first temperature threshold T1 is the upper temperature limit of the inner temperature at which the vacuum pump control device is stably operated, the second temperature threshold T2 is the lower temperature limit of the inner temperature at which the vacuum pump control device is stably operated, the first time threshold t1 is set as a time until temperature distribution in the housing is stabilized, and the second time threshold t2 is a time set for preventing prompt occurrence of dew condensation due to refrigerant supply after dew condensation has been eliminated.

* * * * *